US008079478B2

(12) United States Patent
Short et al.

(10) Patent No.: US 8,079,478 B2
(45) Date of Patent: Dec. 20, 2011

(54) RETAIL FRAGRANCE SAMPLING DISPLAY

(75) Inventors: Michael E. Short, Racine, WI (US); David A. Hoadley, Racine, WI (US); Scott W. Demarest, Caledonia, WI (US); Kit R. Morris, Austin, TX (US); Sunny Kim, Austin, TX (US); David R. Carlson, Cedarburg, WI (US); Mark E. Johnson, Mount Prospect, IL (US)

(73) Assignee: S.C. Johnson & Son, Inc., Racine, WI (US)

( * ) Notice: Subject to any disclaimer, the term of this patent is extended or adjusted under 35 U.S.C. 154(b) by 253 days.

(21) Appl. No.: 12/498,931

(22) Filed: Jul. 7, 2009

(65) Prior Publication Data

US 2011/0006072 A1 Jan. 13, 2011

(51) Int. Cl.
*B65D 23/12* (2006.01)

(52) U.S. Cl. ..... 206/734; 206/823

(58) Field of Classification Search ..... 206/232, 206/730–735, 459.5, 807, 817, 823; 211/59.2, 211/59.3, 90.01, 90.02, 90.04, 119.003; 312/35, 312/71; 239/47, 57; 422/119, 123
See application file for complete search history.

(56) References Cited

U.S. PATENT DOCUMENTS

| | | | | |
|---|---|---|---|---|
| 3,661,838 | A | | 5/1972 | Enomoto |
| 3,966,902 | A | | 6/1976 | Chromecek |
| D243,647 | S | | 3/1977 | Schoenfeld |
| 4,110,261 | A | | 8/1978 | Newland |
| D269,310 | S | | 6/1983 | Wells |
| 4,405,509 | A | | 9/1983 | Rogers et al. |
| 4,486,169 | A | * | 12/1984 | Lewis ..... 431/253 |
| 4,598,006 | A | | 7/1986 | Sand |
| 4,762,493 | A | | 8/1988 | Anderson |
| D307,088 | S | | 4/1990 | Frieden, Jr. |
| D331,337 | S | | 12/1992 | Krinke et al. |
| 5,282,571 | A | | 2/1994 | Smith et al. |
| D348,122 | S | | 6/1994 | Susini et al. |
| D351,076 | S | | 10/1994 | Eliadis et al. |
| D370,801 | S | | 6/1996 | Oliver et al. |
| D385,581 | S | | 10/1997 | Linz |
| 5,707,696 | A | | 1/1998 | Boxler |
| 5,713,462 | A | | 2/1998 | Hansen |
| 5,955,034 | A | | 9/1999 | Zaunbrecher et al. |

(Continued)

FOREIGN PATENT DOCUMENTS

EP 0 836 170 B1 5/2001

(Continued)

OTHER PUBLICATIONS

International Search Report and Written Opinion dated Sep. 29, 2010 Appl. No. PCT/US2010/001905.

*Primary Examiner* — Luan K Bui

(57) ABSTRACT

A fragrance sampling display for retail environments is disclosed. The sampling display may include a dock having a removable faceplate and sidewalls. The dock may include one or more receptacles and one or more scent modules, wherein each scent module is associated with and partially inserted into only one of the receptacles. The scent modules may be removably disposed in the corresponding receptacles by retractable cords. Each of the scent modules may include a different volatile active corresponding to a different fragrance product and vent holes to facilitate passive emission of the associated fragrance. The vent holes may be configured so as to be substantially sealed while the associated scent module is in its respective receptacle.

19 Claims, 10 Drawing Sheets

U.S. PATENT DOCUMENTS

| | | | | |
|---|---|---|---|---|
| D418,330 | S | 1/2000 | Schumacher | |
| 6,103,201 | A | 8/2000 | Green | |
| D430,432 | S | 9/2000 | Mason | |
| 6,206,189 | B1 | 3/2001 | Huot, Jr. et al. | |
| 6,471,731 | B1 | 10/2002 | Elliott, III et al. | |
| 6,503,285 | B1 | 1/2003 | Murphy | |
| 6,607,275 | B1 | 8/2003 | Cimini et al. | |
| 6,645,479 | B1 | 11/2003 | Shefer et al. | |
| 6,716,276 | B2 | 4/2004 | Loop et al. | |
| D493,309 | S | 7/2004 | Moss et al. | |
| 6,803,033 | B2 | 10/2004 | McGee et al. | |
| 6,827,448 | B2 | 12/2004 | Cimini et al. | |
| 6,899,486 | B2 | 5/2005 | Wetzel et al. | |
| 6,913,733 | B2 | 7/2005 | Hardy et al. | |
| D515,681 | S | 2/2006 | Muir et al. | |
| 7,051,681 | B2 | 5/2006 | Pope | |
| 7,105,064 | B2 | 9/2006 | Popplewell et al. | |
| 7,111,794 | B2 | 9/2006 | Timpson | |
| 7,122,512 | B2 | 10/2006 | Brain et al. | |
| 7,125,835 | B2 | 10/2006 | Bennett et al. | |
| D532,506 | S | 11/2006 | Caserta et al. | |
| D544,086 | S | 6/2007 | Wu | |
| D551,748 | S | 9/2007 | Butler et al. | |
| D553,730 | S | 10/2007 | Wu | |
| D554,247 | S | 10/2007 | Wu | |
| 7,291,187 | B2 | 11/2007 | Welch et al. | |
| 7,294,612 | B2 | 11/2007 | Popplewell et al. | |
| D557,785 | S | 12/2007 | Wu | |
| D557,937 | S | 12/2007 | Hafif | |
| D559,589 | S | 1/2008 | Stellon-Solimine et al. | |
| D577,803 | S | 9/2008 | Fabrega et al. | |
| D577,804 | S | 9/2008 | Fabrega et al. | |
| D578,199 | S | 10/2008 | Fabrega et al. | |
| D578,804 | S | 10/2008 | Norman et al. | |
| 7,431,901 | B2 | 10/2008 | Stiros et al. | |
| 7,566,185 | B2 * | 7/2009 | Samuelson et al. | 401/131 |
| 7,658,307 | B2 * | 2/2010 | Skupin | 224/681 |
| 2003/0000177 | A1 | 1/2003 | Landau | |
| 2003/0199421 | A1 | 10/2003 | Copfer | |
| 2004/0068920 | A1 | 4/2004 | Steele et al. | |
| 2005/0227906 | A1 | 10/2005 | Schudel et al. | |
| 2005/0265904 | A1 | 12/2005 | Hardy et al. | |
| 2006/0104933 | A1 | 5/2006 | Bell et al. | |
| 2006/0169796 | A1 | 8/2006 | Timpson et al. | |
| 2006/0254125 | A1 | 11/2006 | Tully et al. | |
| 2006/0283957 | A1 | 12/2006 | Blumenfeld et al. | |
| 2007/0022644 | A1 | 2/2007 | Lynch et al. | |
| 2007/0032400 | A1 | 2/2007 | Bell et al. | |
| 2007/0056878 | A1 | 3/2007 | Walsh et al. | |
| 2007/0065332 | A1 | 3/2007 | Stiros et al. | |
| 2007/0187516 | A1 | 8/2007 | Bell et al. | |
| 2008/0056959 | A1 * | 3/2008 | Cuthbert | 422/123 |
| 2008/0173665 | A1 | 7/2008 | Oshinski et al. | |
| 2009/0019741 | A1 | 1/2009 | Schwartz et al. | |
| 2009/0294390 | A1 * | 12/2009 | Weshler | 211/119.003 |

FOREIGN PATENT DOCUMENTS

| | | | |
|---|---|---|---|
| EP | 1779885 | A1 | 5/2007 |
| FR | 2768906 | A1 | 4/1999 |

* cited by examiner

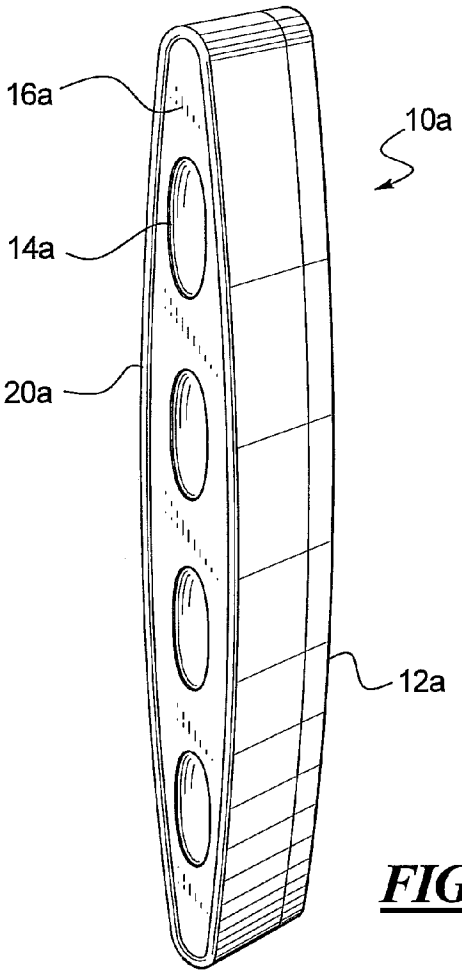
FIG. 2B
FIG. 2A
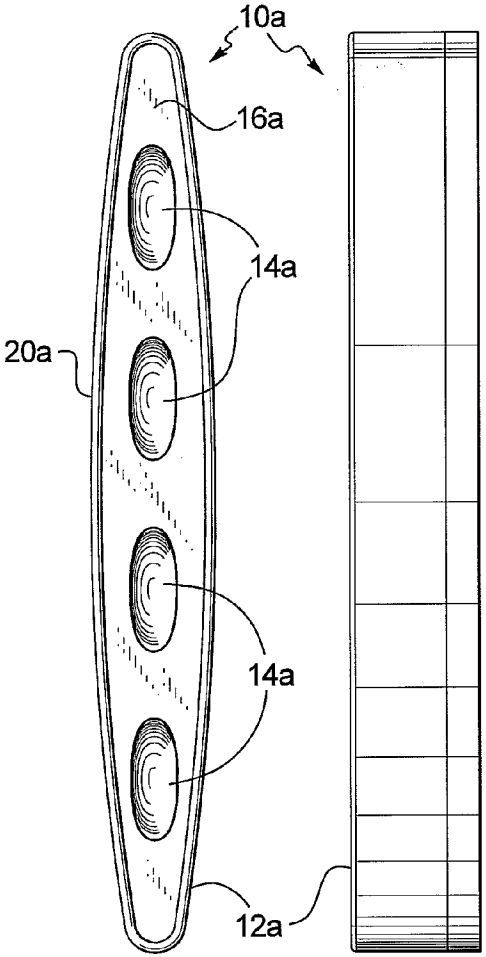

RETAIL FRAGRANCE SAMPLING DISPLAY

FIELD OF THE DISCLOSURE

The present disclosure generally relates to displays for use in retail environments, and more particularly, relates to a sampling display for demonstrating fragrance products.

BACKGROUND OF THE DISCLOSURE

Displays for promoting and demonstrating fragrance products within a retail environment are well known in the art. Such displays serve to catch the attention of consumers and persuade consumers to purchase the product being advertised. To accomplish this, fragrance product displays generally aim to provide pleasing aesthetics and proper samples of the fragrance products. Although appearance is important, consumers prefer to know exactly what the fragrance smells like before purchasing a product for personal or home use. For the most part, descriptions on the packaging or labeling are not sufficient or accurate in describing a scent of the product. Accordingly, displays for promoting a fragrance share the common goal of providing an accurate sample of the fragrance being advertised.

Some of the currently existing solutions range from something as simple as scratch and sniff pads on product packaging to more complex devices which selectively atomize one of a plurality of scents according to user input. Scratch and sniff pads generally wear off too easily and fail to accurately reproduce the actual scent of the product. More complicated devices and atomizers typically take up too much space and are not cost effective. Therefore, displays promoting fragrance products within a retail environment usually resort to providing a plurality of sample bottles or testers to allow consumers to examine each available scent at the point of sale.

Testers are essentially sample bottles or containers of the actual fragrance that consumers can spray into the air or onto a sampling card to examine the fragrance firsthand. However, multiple testers from different manufacturers are usually grouped together in a single area designated for sampling, such as on countertops, shelves, or the like. This takes up a considerable amount of space and adds clutter. Such an arrangement also makes it difficult to distinguish and advertise one particular fragrance product over a competing brand or product line. Additionally, testers are typically provided only for perfumes and colognes, but not for fragrance dispensers designed for the home. Consequently, when selecting a fragrance for home use, consumers are forced to guess by reading the description on package labels, smelling the packaging, or by opening the package in the store.

Furthermore, as fragrance samples and testers are exposed and easily accessible, they are more likely to be misplaced, stolen, damaged, or the like. This can cause confusion or frustration to consumers and the staff of a retail establishment. In addition to being easily accessible, testers tend to lack substantial means of controlling or limiting the amount of the sample to be dispensed per use. For instance, sprays or active fragrance dispensers may be used in excess amounts than is necessary, while opened passive fragrance dispensers may be left unsealed and prone to evaporation. Therefore, providing samples of a fragrance product via testers often results in significant volumes of the product being wasted on refilling or replacing depleted samples.

Therefore, multiple needs exist for an aesthetically pleasing display which provides a proper demonstration of a brand or product line of fragrances. More specifically, needs exist for a display that reduces clutter and sets the products apart from the competition. The need also exists for a fragrance display which provides means of minimizing the amount of the product that is wasted on sampling. An ideal display should also be cost-conscious and provide a display that may be easily installed and readily adaptable to new products or changing retail environments. The display should also require minimal space and be mountable on existing shelving units.

SUMMARY OF THE DISCLOSURE

In accordance with one aspect of the disclosure, a fragrance sampling display apparatus is provided. The fragrance sampling display comprises a dock attachable to a shelving unit; one or more receptacles disposed on a surface of the dock; and one or more scent modules, each scent module comprising a volatile active of a different fragrance, each scent module being associated with and retractably coupled to one of the receptacles, and each scent module being biased into a retracted state.

In accordance with another aspect of the disclosure, a fragrance sampling display apparatus is provided. The fragrance sampling display apparatus comprises a dock attachable to a shelving unit; one or more receptacles disposed on a surface of the dock; and one or more scent modules, each scent module comprising a volatile active of a different fragrance, each scent module being associated with and retractably coupled to one of the receptacles, and each scent module being substantially prohibited from emitting the associated fragrance when in a retracted state.

In accordance with another aspect of the disclosure, a fragrance sampling display apparatus is provided. The fragrance sampling display apparatus comprises a dock attachable to a shelving unit and having a faceplate; one or more receptacles disposed on the faceplate; and one or more scent modules, each scent module comprising a volatile active of a different fragrance, each scent module being associated with and retractably coupled to one of the receptacles with a retractable cord, each scent module being configured to passively emit a fragrance from a surface thereof when removed from the associated receptacle and being substantially prohibited from emitting the associated fragrance when in a retracted state.

These and other aspects of this disclosure will become more readily apparent upon reading the following detailed description when taken in conjunction with the accompanying drawings.

BRIEF DESCRIPTION OF THE DRAWINGS

FIGS. 2A and 2B are front, side and perspective views of a fragrance sampling display;

Figure 4:
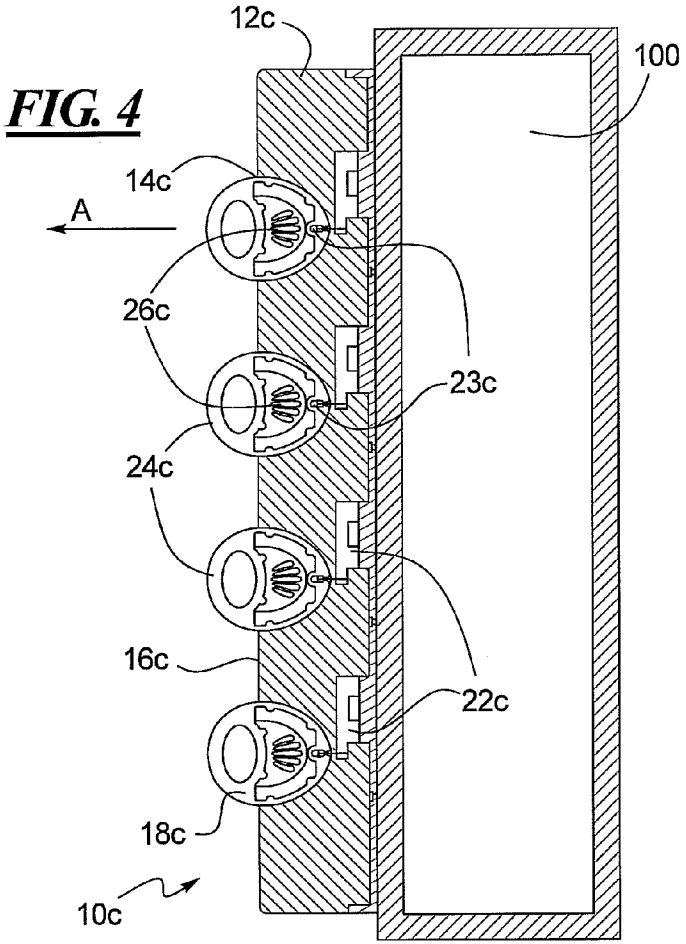
FIG. 4 is a cross-sectional view of a fragrance sampling display.

While the present disclosure is susceptible to various modifications and alternative constructions, certain illustrative embodiments thereof have been shown in the drawings and will be described below in detail. It should be understood, however, that there is no intention to limit the present invention to the specific forms disclosed, but on the contrary, the intention is to cover all modifications, alternative constructions, and equivalents falling with the spirit and scope of the present invention.

DETAILED DESCRIPTION

Figure 1:
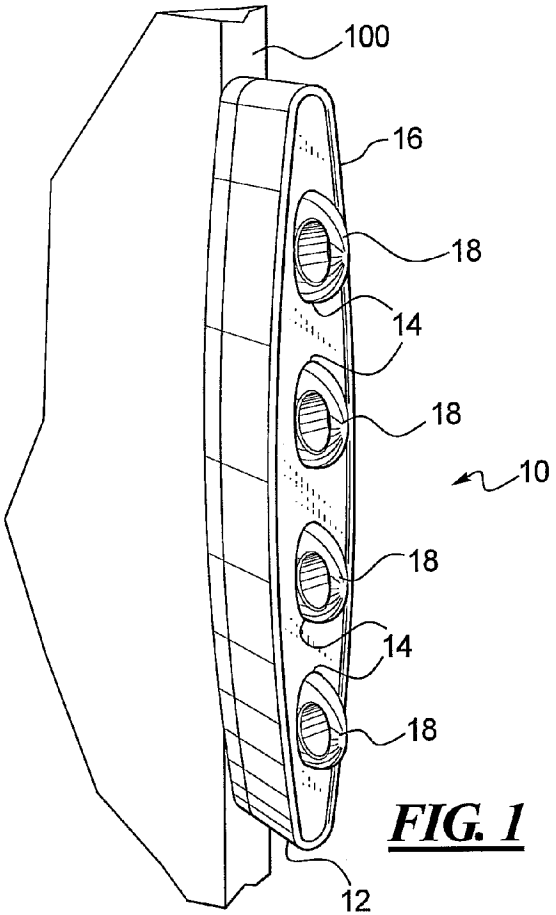
FIG. 1 is a perspective view of an exemplary fragrance sampling display constructed in accordance with the teaching of the disclosure.

Referring now to the drawings and with particular reference to FIG. 1, an exemplary sampling display apparatus for demonstrating fragrance products is provided and referred to as reference number 10. It is understood that the teachings of the disclosure can be used to construct fragrance sampling displays above and beyond that specifically disclosed below. One of ordinary skill in the art will readily understand that the following are exemplary embodiments.

As shown in FIG. 1, a sampling display 10 may conveniently showcase one or more products within a retail establishment. Moreover, the sampling display 10 may allow consumers to accurately sample different fragrances and/or fragrance products belonging to a particular brand, product line, or the like, at the point of sale. The fragrance sampling display 10 may be installed or removably coupled to existing shelves 100 within a retail environment so as to facilitate installation and to reduce costs. The sampling display 10 may also be configured as a standalone display, or provided on a wall, countertop, or the like. In general, the sampling display 10 may include a dock 12 having one or more receptacles 14 disposed on a faceplate or a front surface 16 thereof. The sampling display 10 may further provide one or more removable scent modules 18 that are at least partially received within the receptacles 14 of the dock 12. Each of the scent modules 18 may carry a volatile active substance corresponding to a different fragrance. Consumers that are unsure of the fragrance of a particular product due to product packaging may sample the fragrance firsthand by removing and examining the corresponding scent module 18.

Turning to FIGS. 2A and 2B, another sampling display 10*a* for fragrance products is provided. As shown, the dock 12*a* may be elongated, and further, may include curved sidewalls 20*a* formed of any suitable material such as wood, plastic, metal, or the like. Alternatively, the sidewalls 20*a* may comprise straight panels to form a rectangular body. The faceplate 16*a* may also be formed of any suitable material such as wood, plastic, metal, or the like, and conform to the shape formed by the sidewalls 20*a*. For example, the substantially oval shape of the faceplate 16*a* of FIG. 2B is defined by the curved sidewalls 20*a* of the dock 12*a*. The dock 12*a* additionally provides one or more rounded recesses or receptacles 14*a* linearly disposed along the length of the faceplate 16*a*. Depending on the desired application, alternative arrangements and modifications to the size, shape, and the number of receptacles 14*a* may be provided.

Figure 3B:
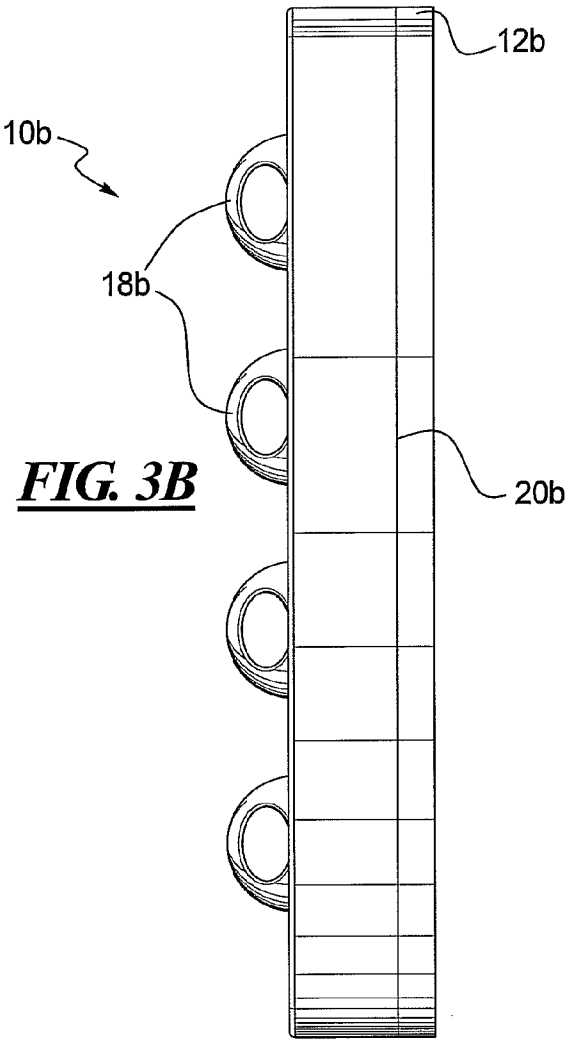
FIGS. 3A and 3B are front and side views of a fragrance sampling display.
Figure 3A:
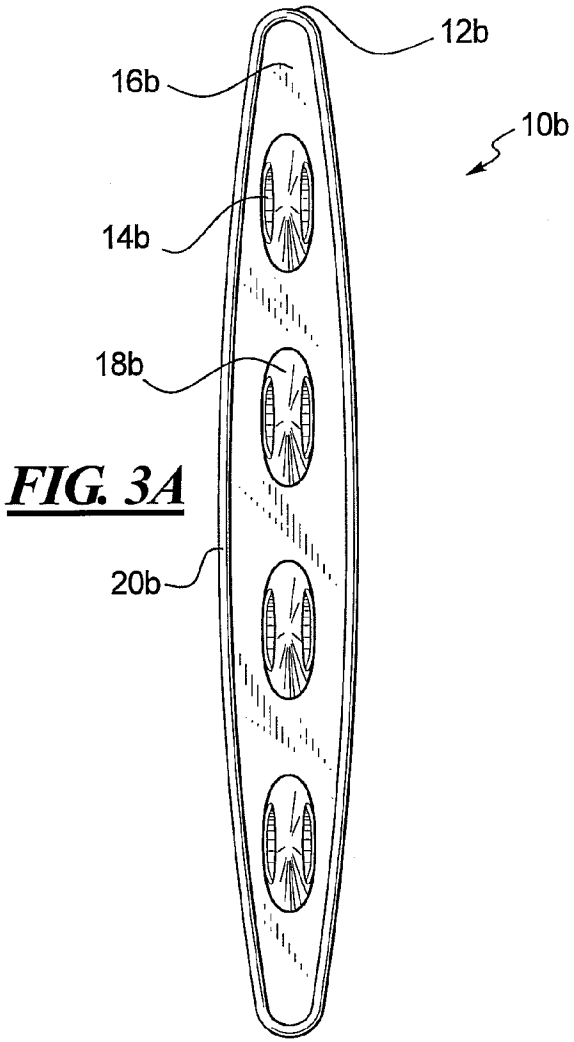

Referring to FIGS. 3A and 3B, another fragrance sampling display 10*b* is provided. As in previous embodiments, the dock 12*b* may include one or more receptacles 14*b*, a faceplate 16*b* and sidewalls 20*b*. While alternative arrangements and modifications may be made, the particular dock 12*b* of FIGS. 3A and 3B provides four oval receptacles 14*b* and a substantially oval faceplate 16*b* that is partially defined by the curved sidewalls 20*b* of the dock 12*b*. The dock 12*b* is also provided with four scent modules 18*b* partially disposed within the four receptacles 14*b*. Each scent module 18*b* may carry a volatile active of a different fragrance or scent, and further, may be associated with only one of the four receptacles 14*b* of the dock 12*b*. Moreover, in contrast to the receptacles 14*a* of FIGS. 2A and 2B, the receptacles 14*b* of FIGS. 3A and 3B may be labeled according to the different fragrances provided. As shown in FIG. 3A, and by way of example only the receptacles 14*b* may be labeled as Tropical, Outdoor Fresh, Fresh Breeze, Apple Spice, and the like. Other names and scents are certainly possible. Accordingly, a scent module 18*b* having a specific scent must be associated with only the receptacle 14*b* labeled as such to avoid confusion. As shown in FIG. 3B, the sidewalls 20*b* may also provide additional graphics and/or text associated with each of the receptacles 14*b* and scent modules 18*b* to further distinguish each of the samples available. Furthermore, the faceplate 16*b* and sidewalls 20*b* may be removably coupled to the dock 12*b* or replaceable such that the labels, text or graphics are readily adaptable to new products and changing retail environments.

To ensure that each scent module 18*c* is retained within its respective receptacle 14*c*, each scent module 18*c* may be retractably coupled to its corresponding receptacle 14*c*, as shown in the cross-sectional view of FIG. 4. More specifically, a retractable cord module 22*c*, or the like, may be disposed within the dock 12*c* and in close proximity to each receptacle 14*c* such that it remains stationary with respect to the display 10*c*. The cord 23*c* of each retractable cord module 22*c* may be coupled to the corresponding scent module 18*c*. Accordingly, each scent module 18*c* may be independently biased toward the dock 12*c* and into the retracted position, as shown in FIG. 4. In order to facilitate removal of the scent modules 18*c* from the dock 12*c*, the scent modules 18*c* may be provided with handles 24*c*, rings, grips, tabs, or the like. To sample a particular fragrance from the display 10*c* of FIG. 4, a consumer may simply remove the corresponding scent module 18*c* from the dock 12*c* by pulling on the handle 24*c* of the scent module 18*c* in the direction shown by arrow A. After examining the fragrance of the scent module 18*c*, the consumer may simply let go of the scent module 18*c* to allow it to retract to its designated receptacle 14*c*.

Still referring to the embodiment of FIG. 4, the scent modules 18*c* may be configured to emit a volatile active or fragrance by passive means. Accordingly, one or more apertures or vent holes 26*c* may be provided on the surface of each scent module 18*c* to facilitate passive emission of a fragrance. However, to prolong the life of the volatile active and to minimize wasted fragrance emissions, the vent holes 26*c* may require sealing means when not in use. For example, the display 10*c* of FIG. 4 is configured so as to substantially seal the vent holes 26*c* of each scent module 18*c* when they are not in use and inserted into their respective receptacles 14*c*. More specifically, the vent holes 26*c* of each scent module 18*c* may be positioned and arranged according to the depth and shape of the receptacles 14*c*. As a result, when a scent module 18*c* is not in use and in its respective receptacle 14*c*, the fitment between the inner surface of the receptacle 14*c* and the outer surface of the scent module 18*c* may substantially seal the vent holes 26*c* and effectively reduce wasted emissions.

Figure 5:
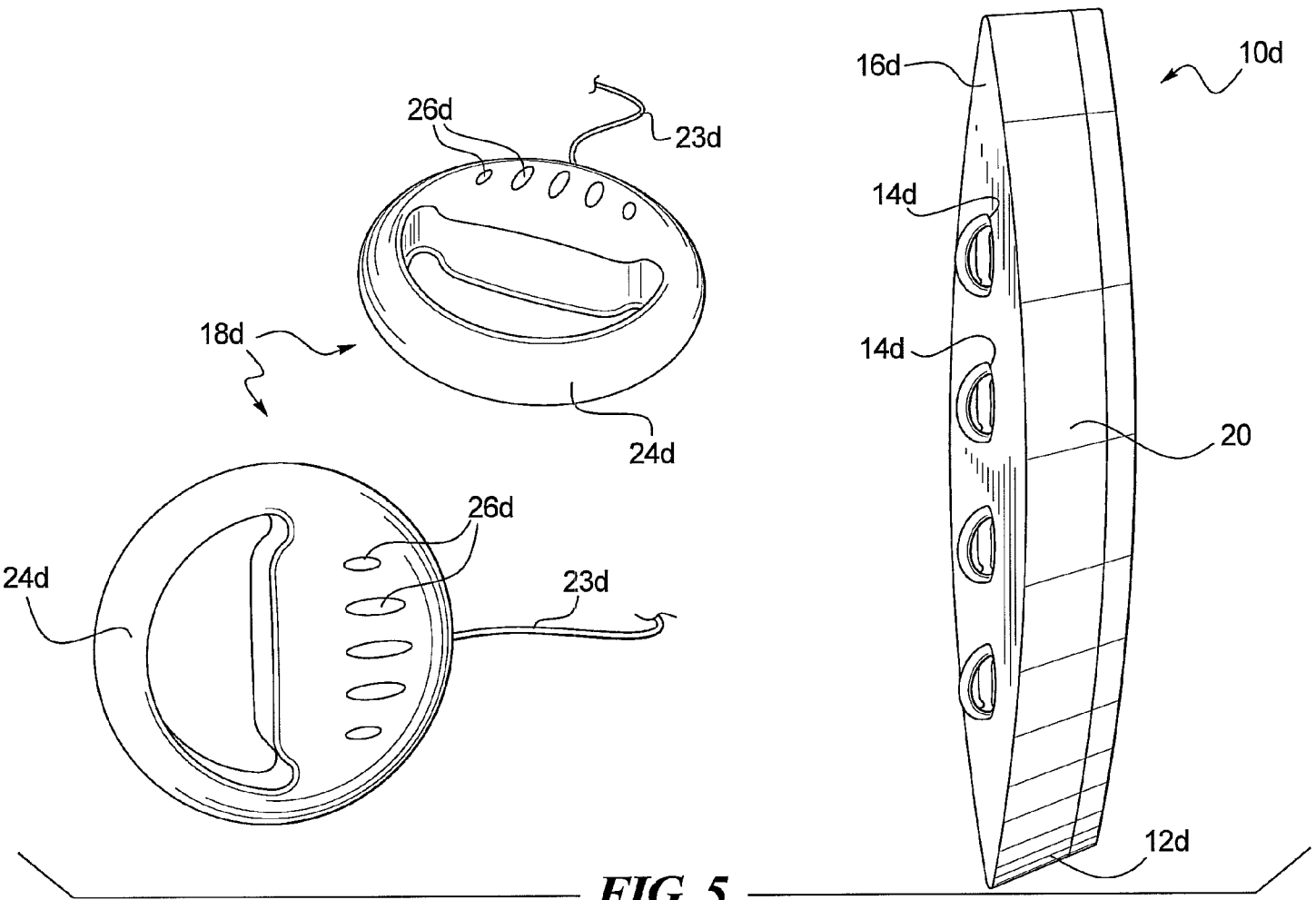
FIG. 5 is a perspective view of another fragrance sampling display.

Turning now to FIG. 5, another exemplary fragrance sampling display 10*d* is provided. The sampling display 10*d* of FIG. 5 may be mounted horizontally or vertically and includes a dock 12*d* with one or more receptacles 14*d*, a substantially oval faceplate 16*d* and curved sidewalls 20*d*. As opposed to the previous embodiments, the sidewalls 20*d* of the dock 12*d* may be formed of acrylic, or any other transparent or translucent material. The dock 12*d* may also be provided with one or more scent modules 18*d* that are held in the respective receptacles 14*d* by retractable cords 23*d*, or the like. Each scent module 18*d* may be provided with ring-like handles 24*d* to allow a consumer to easily pull the scent module 18*d* out and away from the dock 12*d* for sampling. The scent modules 18*d* may further include vent holes 26*d* to facilitate fragrance emissions. As disclosed in previous embodiments, the vent holes 26*d* of FIG. 5 are positioned so as to be substantially sealed when the scent modules 18*d* are reinserted into the respective receptacles 14*d*. Alternatively, a surface of the scent modules 18*d* may be formed of the associated volatile active. For example, the surface of each scent module 18*d* may be molded of a plastics material, or the like, that is compounded with the associated volatile active so as to passively emit a fragrance directly from the surface thereof.

Figure 6:
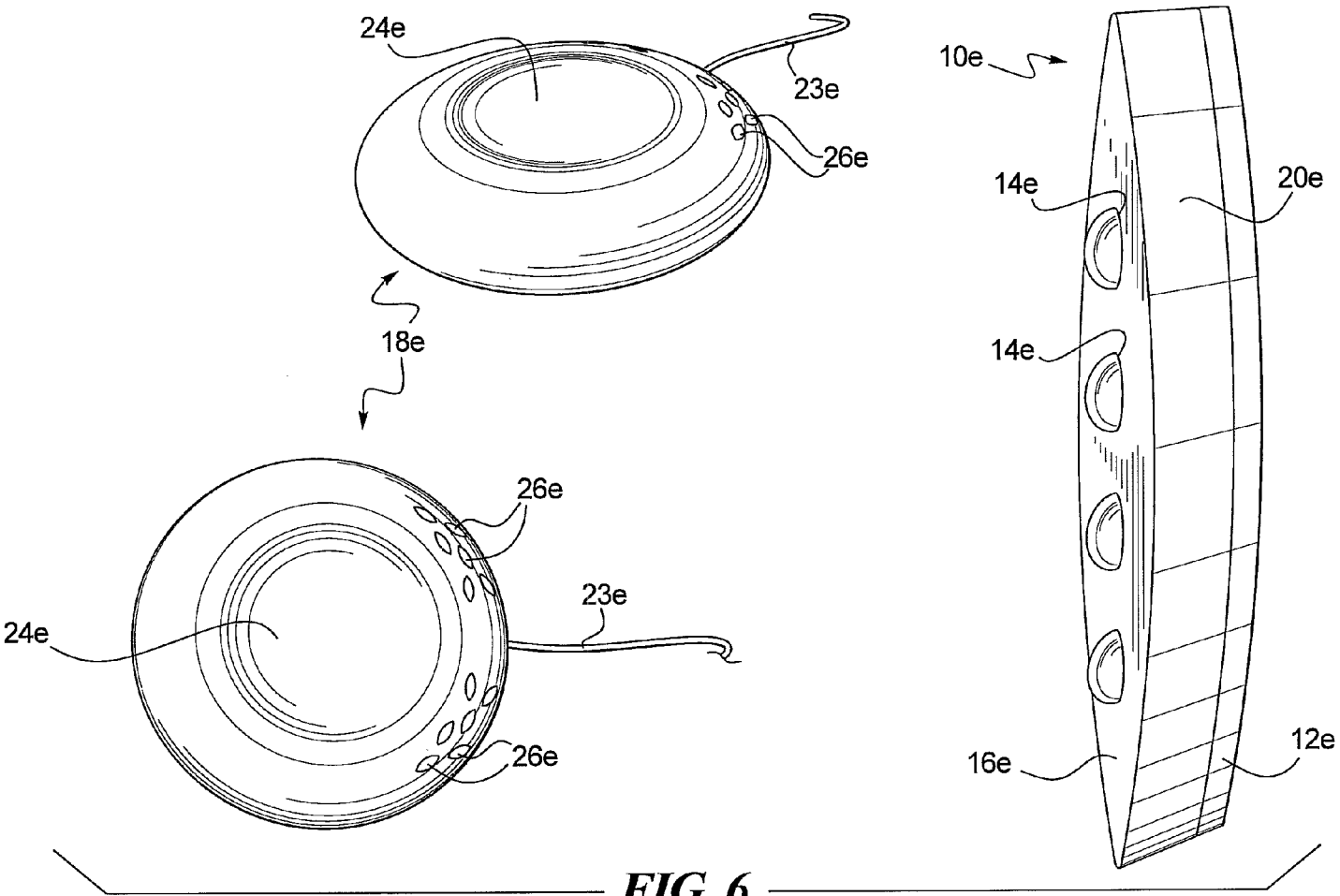
FIG. 6 is a perspective view of yet another fragrance sampling display.

Referring to FIG. 6, another fragrance sampling display 10*e* is provided having similar features as with the display 10*d* of FIG. 5. The sampling display 10*e* of FIG. 6 may also be mounted horizontally or vertically and includes a dock 12*e* with one or more receptacles 14*e*, a substantially oval faceplate 16*e* and curved sidewalls 20*e*. The faceplate 16*e* and sidewalls 20*e* of the dock 12*e* may be formed of acrylic, or any other transparent or translucent material. The sampling display 10*e* may also include one or more scent modules 18*e* with transparent or translucent outer surfaces to provide a more aesthetically pleasing effect. The scent modules 18*e* may be held in the respective receptacles 14*e* by retractable cords 23*e* and retractable cord modules hidden within the base of the dock 12*e*. As opposed to the previous embodiments, each scent module 18*e* may provide a gripping surface 24*e* rather than a handle to allow easier consumer access to the fragrance samples. The scent modules 18*e* may further include vent holes 26*e* positioned so as to be substantially sealed when the scent modules 18*e* are reinserted into the respective receptacles 14*e*.

Figure 7:
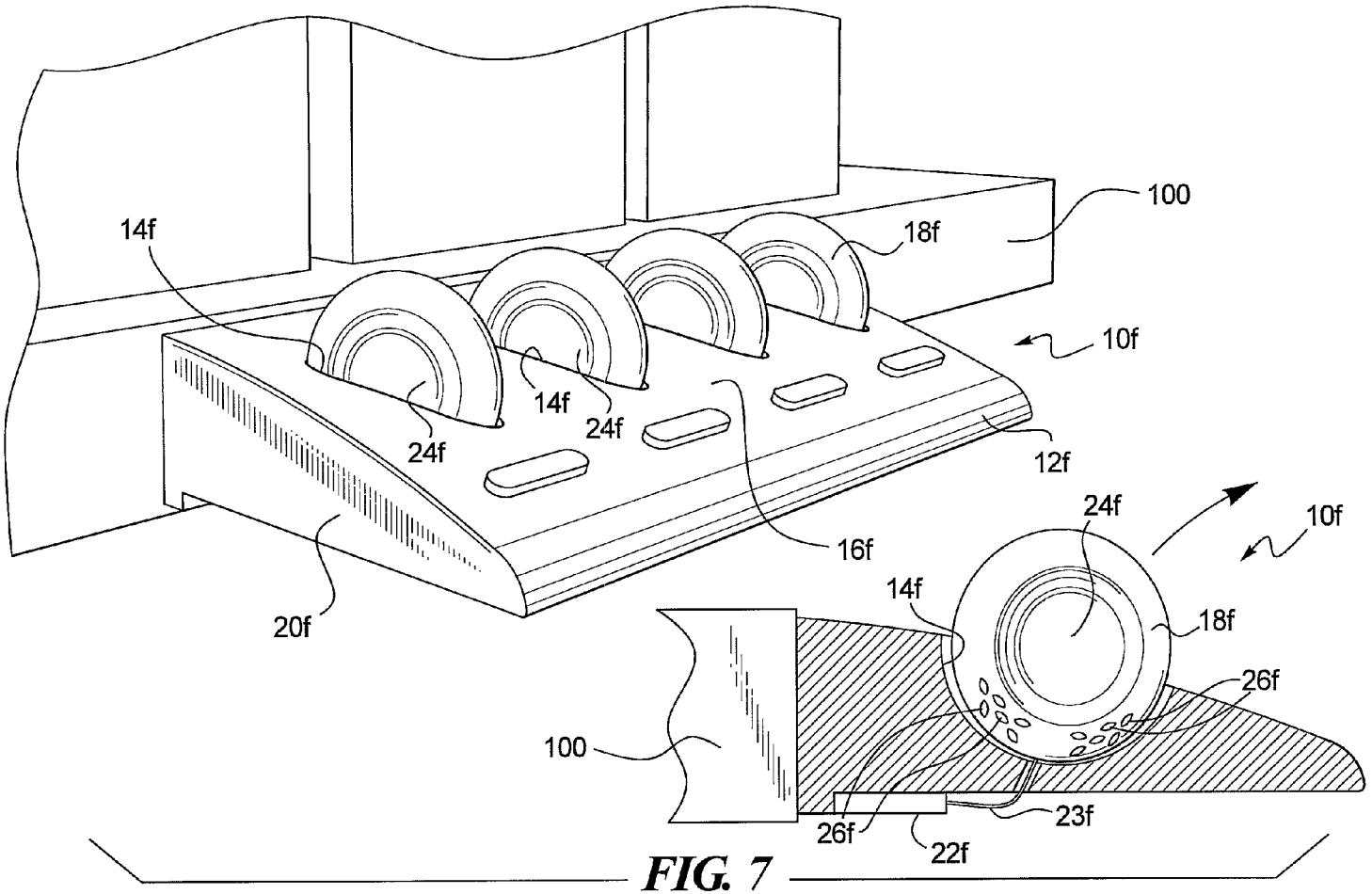
FIG. 7 is a perspective view of a horizontally mounted fragrance sampling display.

Referring now to FIG. 7, yet another fragrance sampling display 10*f* is provided. Similar to previous embodiments, the sampling display 10*f* may include a dock 12*f*, one or more receptacles 14*f*, a front surface or faceplate 16*f*, sidewalls 20*f* and one or more scent modules 18*f* partially disposed within the receptacles 14*f* of the dock 12*f*. One or more retractable cord modules 22*f* may be fixed underneath the dock 12*f* and in close proximity to the respective receptacles 14*f* so as to remain stationary with respect to the sampling display 10*f*. The cord 23*f* of each retractable cord module 22*f* may be coupled to the respective scent module 18*f* to bias scent module 18*f* into the default position, as shown in FIG. 7. As with in the embodiments of FIG. 6, each scent module 18*f* may include gripping surfaces 24*f* rather than a handle to allow easier consumer access to the fragrance samples. The scent modules 18*f* may further include vent holes 26*f* positioned so as to be substantially sealed when the scent modules 18*f* are not in use. Furthermore, in the particular embodiment of FIG. 7, the sampling display 10*f* is mounted horizontally onto an existing shelf structure 100. However, as the scent modules 18*f* are biased into the respective receptacles 14*f*, the display 10*f* may also be mounted vertically, diagonally, or any other suitable orientation.

Figure 8A:
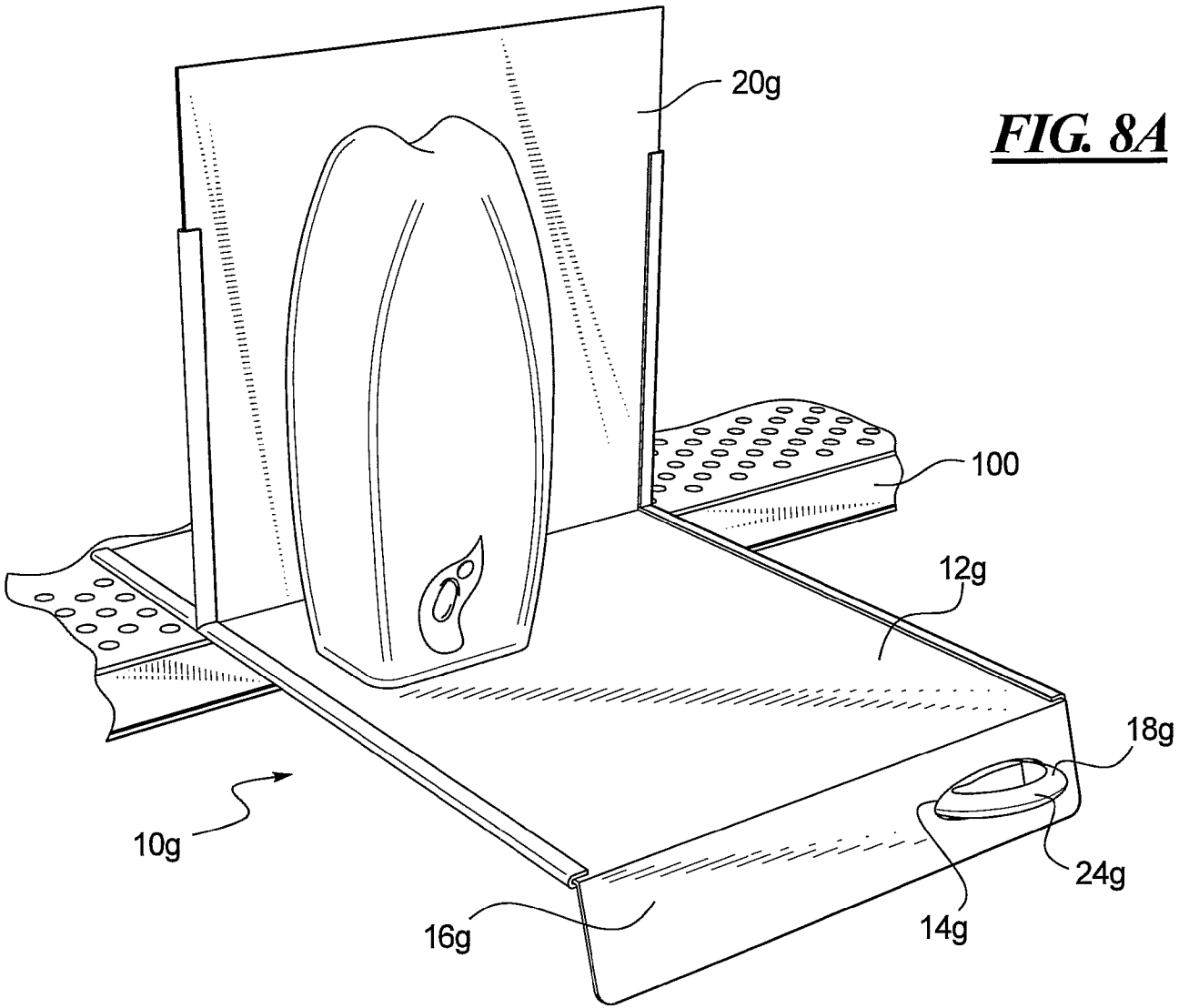
FIGS. 8A-8C are various views of another horizontally mounted fragrance sampling display.
Figure 8B:
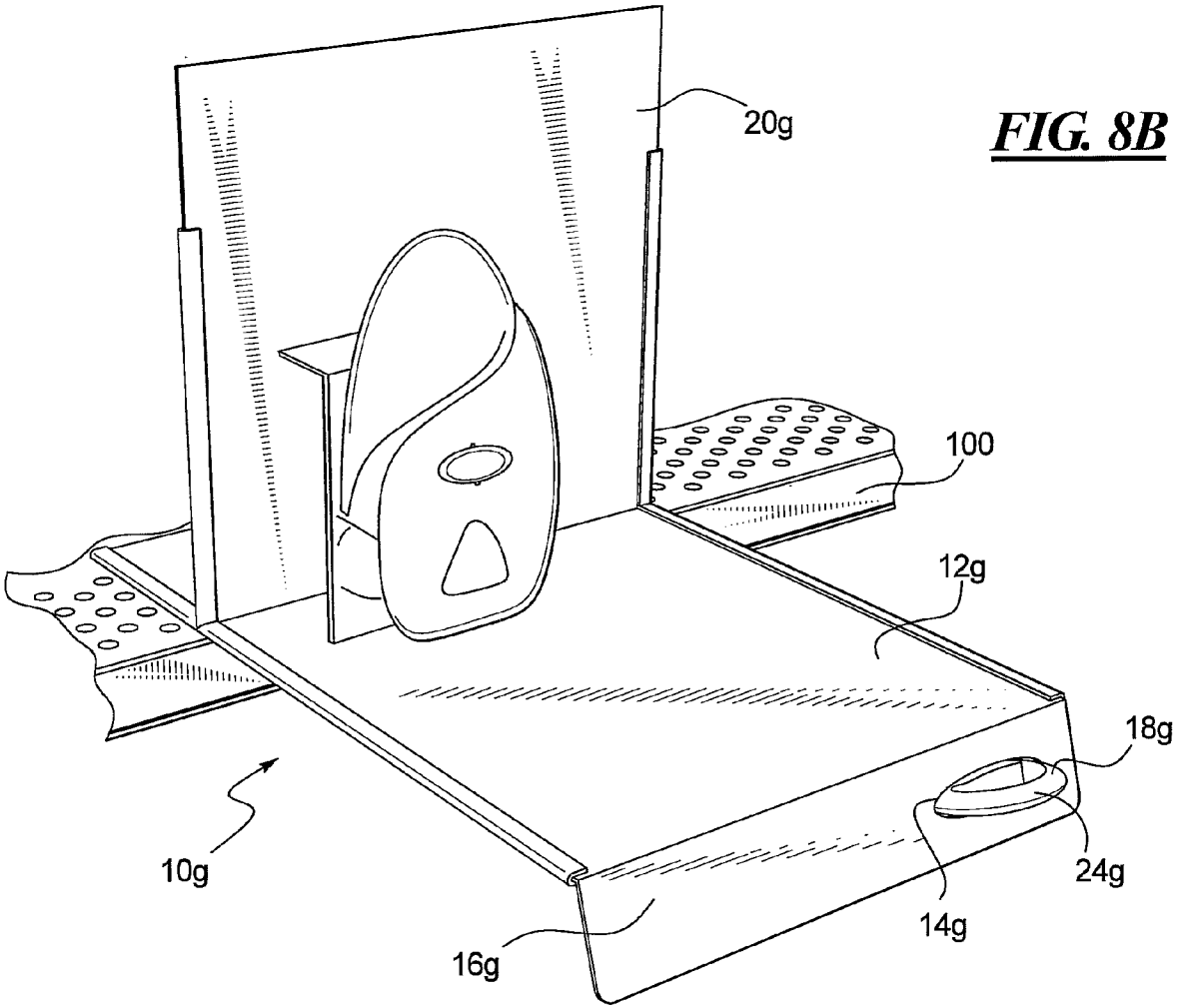
Figure 8C:
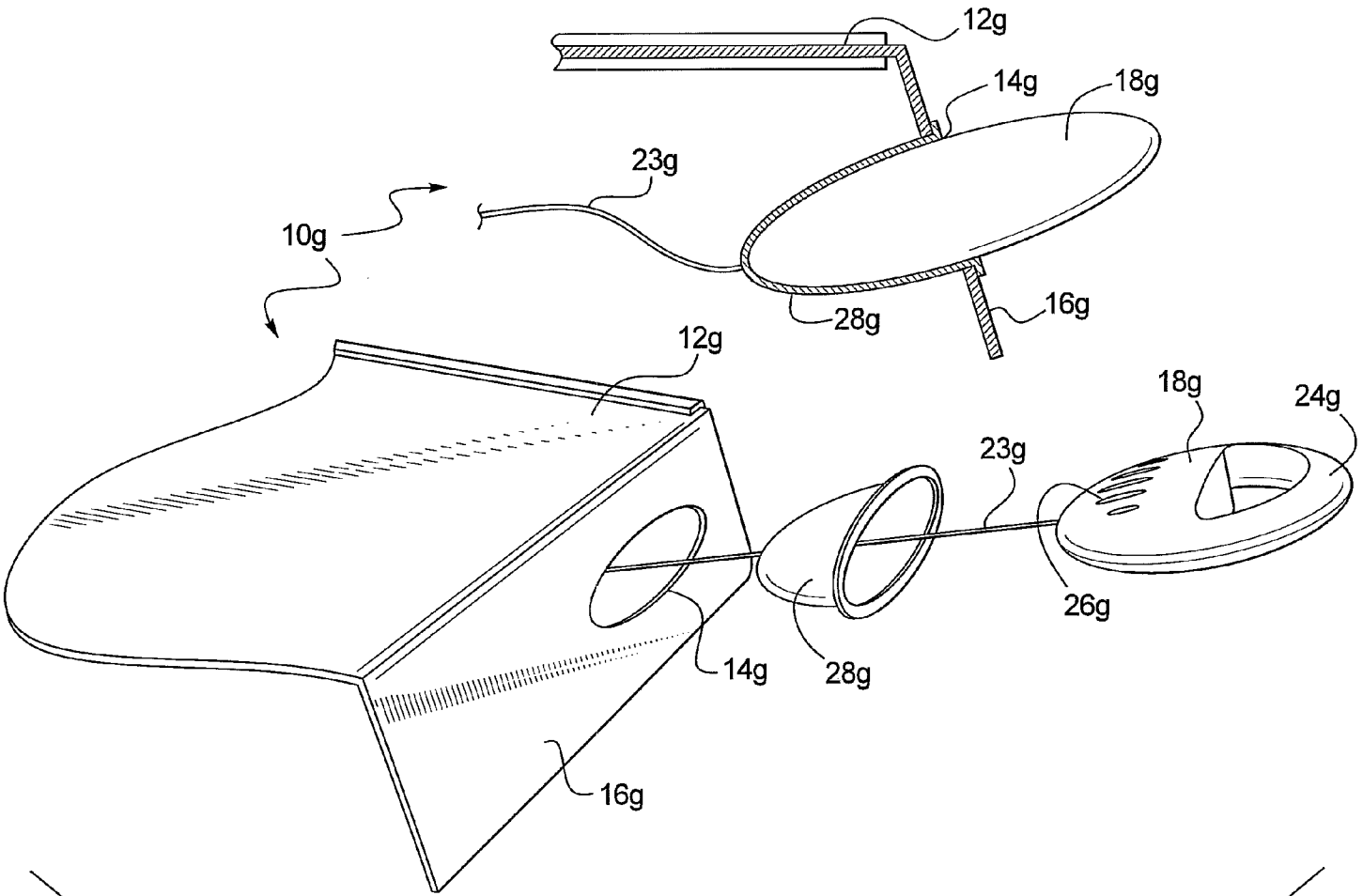

Turning to FIGS. 8A-8C, various views of another fragrance sampling display 10*g* is provided. The sampling display 10*g* may include a dock 12*g*, one or more receptacles 14*g*, a front surface or faceplate 16*g*, a wall 20*g* and one or more scent modules 18*g* partially disposed within the receptacles 14*g* of the dock 12*g*. One or more retractable cord modules (not shown) may be fixed underneath the dock 12*g* and in close proximity to the respective receptacles 14*g* so as to remain stationary with respect to the sampling display 10*g*. Each retractable cord 23*g* may be coupled to the respective scent module 18*g* to bias the scent module 18*h* into the default retracted position. The scent modules 18*g* may further include vent holes 26*g* positioned so as to be substantially sealed when the scent modules 18*g* are not in use. As shown in FIG. 8C, the receptacles 14*g* of the display 10*g* may also include pockets 28*g* to further help support the respective scent modules 18*g* and to substantially prevent fragrance emissions when the scent modules 18*g* are in the retracted state.

Figure 9:
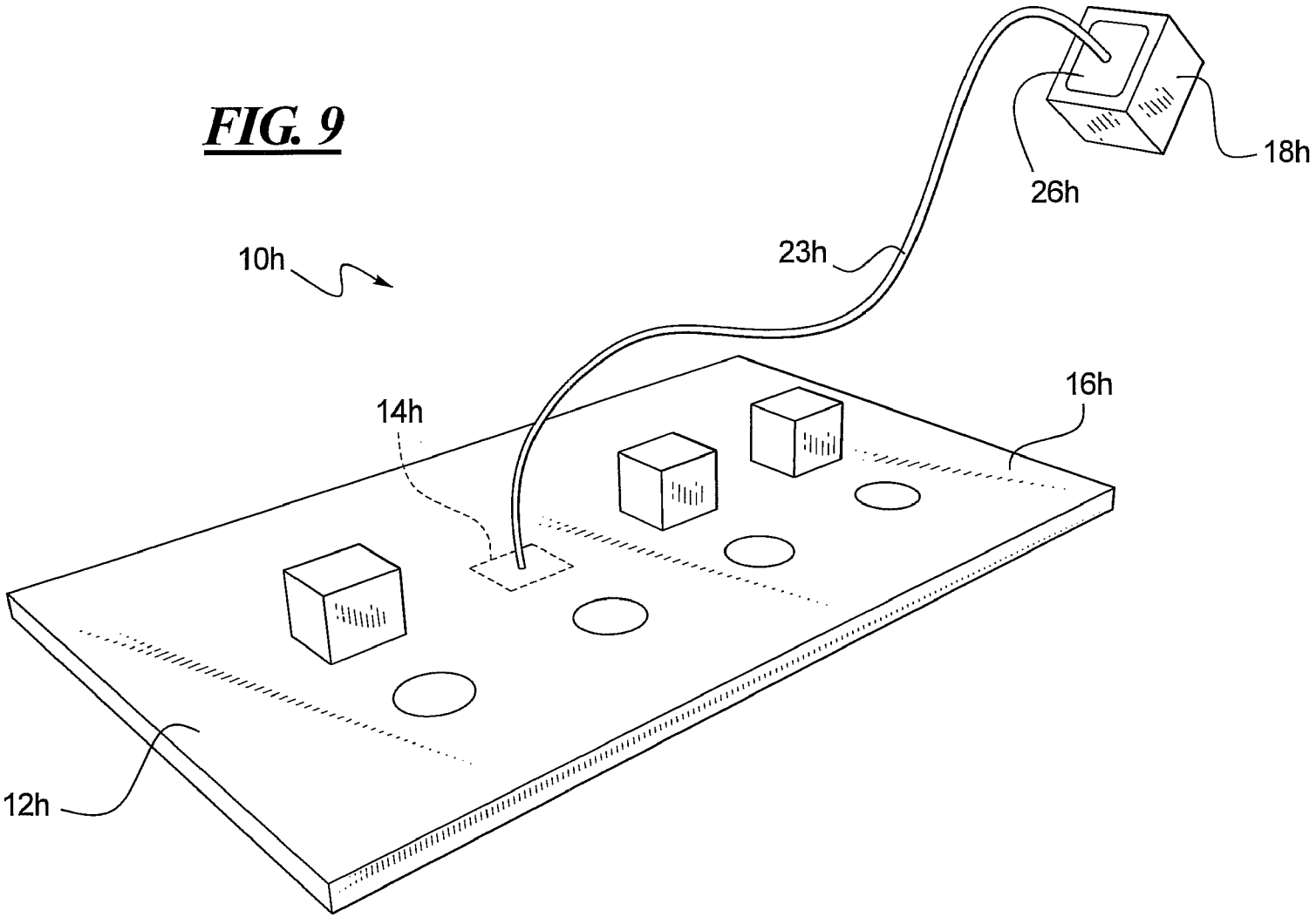
FIG. 9 is a perspective view of yet another horizontally mounted fragrance sampling display.

Referring now to FIG. 9, yet another fragrance sampling display 10*h* is provided. Similar to previous embodiments, the sampling display 10*h* may include a dock 12*h*, one or more receptacles 14*h*, a faceplate 16*h* and one or more scent modules 18*h* retractably coupled to the receptacles 14*h*. Unlike previous embodiments, the receptacles 14*h* may be configured to be flush with the faceplate 16*h* and not recessed. One or more retractable cord modules (not shown) may be fixed underneath the dock 12*h* and in close proximity to the respective receptacles 14*h* so as to remain stationary with respect to the sampling display 10*h*. Each retractable cord 23*h* may be coupled to the respective scent module 18*h* to bias the respective scent module 18*h* into the default retracted position. Rather than vent holes, the scent modules 18*h* of the embodiment of FIG. 9 may provide a volatile active directly on a designated surface 26*h* thereof. In particular, an emitter surface 26*h* of each scent module 18*h* may be at least partially formed or molded of a compound material which includes the associated volatile active material therein. As shown, the flat interface between the receptacle 14*h* and the emitter surface 26*h* may serve to substantially seal or prevent fragrance emissions when the scent module 18*h* is not in use and in the retracted state. Each of the receptacles 14*h* may also be partially recessed and/or provided with a seal to further prevent fragrance emissions.

Based on the foregoing, it can be seen that the present disclosure provides an aesthetically pleasing display which properly promotes and demonstrates a brand or product line of fragrances. More specifically, the present disclosure provides a compact display that reduces clutter and sets the sampled products apart from the competition. The fragrance display requires minimal space and is mountable on existing shelving units. The fragrance display is also cost-conscious in that it provides means of minimizing the amount of the product that is wasted on sampling. Furthermore, the fragrance display is also readily adaptable to new products or changing retail environments.

While only certain embodiments have been set forth, alternatives and modifications will be apparent from the above description to those skilled in the art. These and other alternatives are considered equivalents and within the spirit and scope of this disclosure.

What is claimed is:

1. A fragrance sampling display apparatus, comprising:

a dock attachable to a shelving unit;

one or more receptacles disposed on a surface of the dock; and one or more scent modules, each scent module comprising a volatile active of a different fragrance, each scent module being associated with and retractably coupled to one of the receptacles, and each scent module being based into a retracted state, each scent module including at least one vent hole, the at least one vent hole being closed by one of the receptacles when in the retracted state to seal the vent, hole from emitting fragrance.

2. The fragrance sampling display apparatus of claim 1, wherein each scent module is substantially prohibited from emitting the associated fragrance when in the retracted state.

3. The fragrance sampling display apparatus of claim 1, wherein a surface of each scent module is formed of the associated volatile active.

4. The fragrance sampling display apparatus of claim 3, wherein the surface of each scent module is molded of a material compounded with the associated volatile active.

5. The fragrance sampling display apparatus of claim 1, wherein each scent module provides vent holes through which the associated volatile active is passively released.

6. The fragrance sampling display apparatus of claim 1, wherein each scent modules is at least partially received in the associated receptacle when in the retracted state.

7. The fragrance sampling display apparatus of claim 1, wherein each receptacle is labeled according to the fragrance of the associated scent module.

8. The fragrance sampling display apparatus of claim 1, wherein each scent module is coupled to the associated receptacle with a retractable cord.

9. The fragrance sampling display apparatus of claim 1, wherein each scent module provides a handle.

10. The fragrance sampling display apparatus of claim 1, wherein the dock is elongated and horizontally coupled to the shelving unit.

11. A fragrance sampling display apparatus, comprising:

a dock attachable to a shelving unit;

one or more receptacles disposed on a surface of the dock; and one or more scent modules, each scent module comprising a volatile active of a different fragrance, each scent module being associated with and retractably coupled to one of the receptacles, and each scent modules being substantially prohibited from emitting the associated fragrance when in a retracted state, wherein a surface of each scent module is formed of the associated volatile active.

12. The fragrance sampling display apparatus of claim 11, wherein each scent module is at least partially received in the associated receptacle when in the retracted state.

13. The fragrance sampling display apparatus of claim 11, wherein each scent module provides vent holes through which the associated volatile active is passively released.

14. The fragrance sampling display apparatus of claim 11, wherein each scent module is coupled to the associated receptacle with a retractable cord.

15. A fragrance sampling display apparatus, comprising:

a dock attachable to a shelving unit ad having a faceplate;

one or more receptacles disposed on the faceplate; and one or more scent modules, each scent module comprising a volatile active of a different fragrance, each scent module being associated with and retractably coupled to one of the receptacles with a retractable cord, each scent module being configured to passively emit a fragrance from a surface thereof when removed from the associated receptacle and being substantially prohibited from emitting the associated fragrance when in a retracted state, each scent module being fully received into one of the receptacles when retracted to seal the surface against emitting fragrance.

16. The fragrance sampling display apparatus of claim 15, wherein a surface of each scent module is formed of the associated volatile active.

17. The fragrance sampling display apparatus of claim 16, wherein the surface of each scent module is molded of a material compounded with the associated volatile active.

18. The fragrance sampling display apparatus of claim 15, wherein each scent module provides vent holes through which the associated volatile active is passively released.

19. The fragrance sampling display apparatus of claim 15, wherein each scent module is at least partially received in the associated receptacle when in the retracted state.

* * * * *